US010258175B2

(12) United States Patent
Reuben

(10) Patent No.: US 10,258,175 B2
(45) Date of Patent: Apr. 16, 2019

(54) DUVET COVER WITH DOWN FEATHER SHEET

(71) Applicant: Ronie Reuben, Town of Mount Royal (CA)

(72) Inventor: Ronie Reuben, Town of Mount Royal (CA)

( * ) Notice: Subject to any disclaimer, the term of this patent is extended or adjusted under 35 U.S.C. 154(b) by 483 days.

(21) Appl. No.: 14/998,927

(22) Filed: Mar. 7, 2016

(65) Prior Publication Data

US 2016/0270565 A1 Sep. 22, 2016

(30) Foreign Application Priority Data

Mar. 16, 2015 (CA) ..... 2882023

(51) Int. Cl.
*A47G 9/02* (2006.01)

(52) U.S. Cl.
CPC ..... *A47G 9/0207* (2013.01)

(58) Field of Classification Search
CPC ..... A47G 9/02; A47G 9/207; A47G 9/0261; A47G 9/0223; A47G 9/04; A47G 9/0284; A47G 2009/004
See application file for complete search history.

(56) References Cited

U.S. PATENT DOCUMENTS 2,960,702 A * 11/1960 Hermine ..... A47C 27/22 24/380
3,008,152 A * 11/1961 Seidenberg ..... A47G 9/0261 5/501
3,405,674 A * 10/1968 Coates ..... D04H 1/02 112/420
5,459,894 A * 10/1995 Buonocore ..... A47C 27/22 5/737
5,799,600 A * 9/1998 Reuben ..... A47G 9/0207 112/420
6,025,041 A * 2/2000 Reuben ..... A47G 9/0207 428/15
9,314,059 B2 * 4/2016 Kanayama ..... A41D 31/02
2007/0088392 A1 * 4/2007 Skiba ..... A43B 1/0045 607/2
2009/0070933 A1 * 3/2009 Hall ..... A47G 9/02 5/496
2013/0136892 A1 * 5/2013 Ozawa ..... A47C 27/12 428/114
2014/0373277 A1 * 12/2014 Fan ..... A47G 9/0223 5/502
2015/0196145 A1 * 7/2015 Reuben ..... D04H 1/559 5/502
2016/0355958 A1 * 12/2016 Grynaeus ..... D04H 1/02
2018/0116317 A1 * 5/2018 Inoue ..... A41D 3/00

* cited by examiner

*Primary Examiner* — Eric J Kurilla
(74) *Attorney, Agent, or Firm* — Guy J. Houle; Houle Patent Agency Inc.

(57) ABSTRACT

A duvet cover is comprised of a base sheet and a top sheet interconnected together by a peripheral stitched seam. A down feather sheet is retained between the base sheet and the top sheet. The down feather sheet has a substantially constant density of down feathers with the down feathers being retained captive by a binder thereby the duvet cover has a substantially constant insulating factor throughout because the down feathers are immovably retained therein. Such a duvet cover permits the creation of all sorts of stitched or quilted designs therein without concern for the propagation of the down feathers between the base sheet and the top sheet of the duvet which would create irregular insulation.

6 Claims, 6 Drawing Sheets

DUVET COVER WITH DOWN FEATHER SHEET

TECHNICAL FIELD

The present invention relates to duvet covers and more particularly to a down cover having an internal down feather sheet of substantially constant thermal efficiency, or fill power and wherein the down feathers are prevented from displacement during fabrication and use of the duvet cover.

BACKGROUND OF THE INVENTION

Duvet covers having down insulation trapped between the base sheet and top sheet of the duvet cover are well known in the art. It is also well known that down feathers provide excellent insulating properties. The higher the fill power (fluffiness) of the down and therefore the more air trapped in the down, the more insulating ability an ounce of the down will have. Down is also a very light product that is desirable for insulation and particularly with products wherein weight is a factor, such as articles of apparel, sleeping bags, duvet covers, etc. However, down is a difficult product to work with due to its fluffy nature and unstable condition. It can also be hazardous to one's health has its fluffy miniscule filaments easily propagate into the surrounding air. For this reason work personnel are advised to wear breathing masks.

Articles of apparel and bedding manufactured with down feather insulation are constructed by entrapping the down between opposed fabric sheets. To prevent the down from displacement, the fabric sheets are sewn with quilt stitched patterns. Some of these patterns are produced by cross-stitches to form small pockets in which the down feathers are trapped. See U.S. Pat. No. 5,692,245 as an example. With bedding products, such as duvet cover, the quilt stitches may be spaced apart from about 1 inch to 10 inches forming pockets with loose down therein. During use of these products, the down shifts within the pockets and form areas where the down is concentrated and other areas where there is much less down or no down. This results in areas where there is too much insulation or not enough insulation. Furthermore, because the down is loose between the fabric sheets at the time of stitching, the down is not uniformly distributed between the fabric sheets resulting in stitching being done Over heavy down underlay or no down at all creating irregularities in the stitched seams which are visible to the eye or resulting in a rejection of the manufactured product. Because duvet covers are made with large cross stitched quilt patterns and consequently large pockets for retaining the down, the down will propagate to corners of these pocket and unevenly therein. In the case of duvet covers having no quilt stitches, the down always propagate into regions and it is then necessary to shake the duvet in an attempt to distribute the down substantially evenly therein but such is near to impossible. Accordingly, the duvet cover has to be shaken constantly due to the unstable nature of the down.

U.S. Pat. No. 6,025,041 addresses the problem of using the loose fluffy down feathers in the manufacture of articles and relates to a method of forming a down feather sheet of substantially constant thickness and particularly for use in the fabrication of articles of apparel such as described in U.S. Pat. No. 5,692,245.

It is also desirable with duvet covers to provide different thermal properties for each sleeping side of a bed, as described and demonstrated in US Patent Publication 2005/0268399. It is also well known that the body of a person, when sleeping, requires less covering and thermal insulation in certain sections of its body.

It would also be desirable to manufacture light weight duvet covers having esthetically pleasing stitch patterns and designs without concern to the size of the spaces formed between the design pattern stitch seams where loose down feathers could be unstable or the complexity of the stitch patterns.

SUMMARY OF THE INVENTION

It is a feature of the present invention to provide a duvet cover which substantially overcomes the above mentioned disadvantages of prior art duvet covers and provides the above mentioned needs.

Another feature of the present invention to provide a duvet cover having all sorts of stitched design pattern wherein the propagation of down feathers in irregular pockets formed by the stitch seam patterns is not an issue.

A further feature of the present invention is to provide a duvet cover wherein pockets are formed to accommodate down feather sheets having different insulation factors.

A still further feature of the present invention is to provide a duvet cover having a down feather sheet secured inside the duvet cover and which can be disposed in a deployed or stored position.

According to the above features, from a broad aspect, the present invention provides a duvet cover which is comprised of a base sheet and a top sheet interconnected together by stitched seams. A down r sheet is retained between the base sheet and the top sheet. The down feather sheet has a substantially constant density of down feathers with the down feathers being retained captive by a binder.

DESCRIPTION OF DRAWINGS

A preferred embodiment of the present invention will now be described with reference to the accompanying drawings in which.

DESCRIPTION OF THE PREFERRED EMBODIMENT

Figure 1:
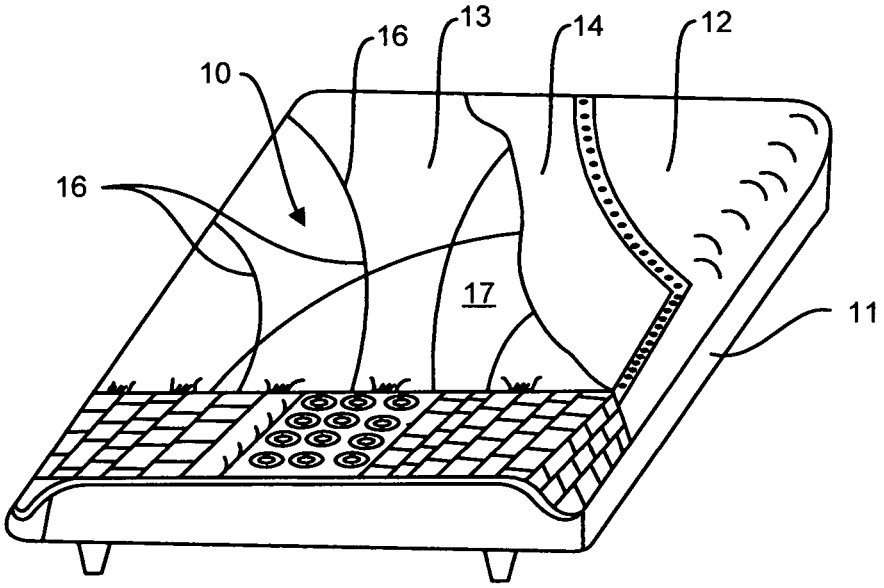
FIG. 1 is a perspective view of a duvet cover constructed in accordance with the present invention and wherein a decorative stitched design pattern is formed in a section of the duvet cover.
Figure 2A:
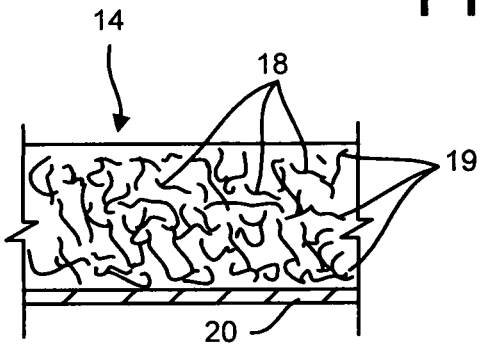
FIG. 2A is a cross-section view of a down feather sheet comprised of down feathers held together by binder fibers and adhered on a backing sheet.
Figure 2B:
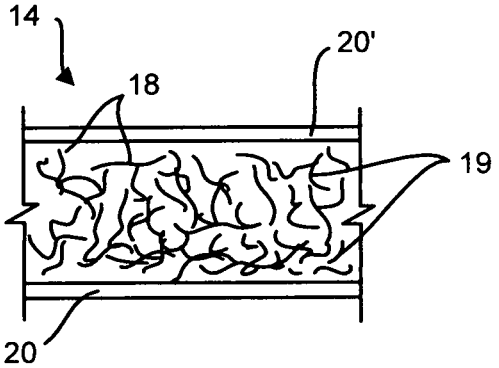
FIG. 2B is a cross-section view, similar to FIG. 2A, but wherein the down feathers are held between opposed sheets.
Figure 3:
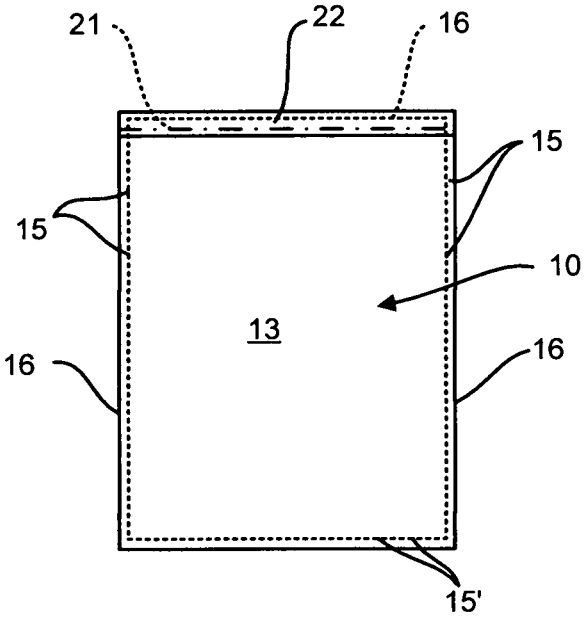
FIG. 3 is a plan view of a duvet cover wherein a down feather sheet is held captive between the base and top sheets of the duvet and a peripheral stitch seam.

Referring now to the drawings, and more particularly to FIGS. 1 to 3, there is shown a duvet cover 10 constructed in accordance with the present invention and disposed on a bed 11. The duvet cover 10 is formed by a base sheet 12 and a top sheet 13 and a down feather sheet 14 disposed there between and interconnected together by stitched seams 15 or 16 or both. As shown in FIG. 3, stitched seams 15 are formed along the peripheral edges 16 of the duvet cover 10 to interconnect the base sheet 12 and the top sheet 13 and which forms a pocket in which the down feather sheet 14 is immovably trapped there between or sewn captive along one or more of the stitched seams 15. As shown in FIG. 1 the down feather sheet 14, trapped between the base sheet 12 and the top sheet 13, is additionally secured by irregularly disposed design pattern stitched seams 16 to give an esthetically pleasing appearance to the duvet cover without concern to the large areas or pocket, such as areas 17, formed between stitch seams 16 spaced far apart as the down is held captive in the down feather sheet 14 and does not propagate. The stitch seams 16 extend through the top sheet 13, the down feather sheet 14 and the base sheet 12. Accordingly, the down heathers are not displaced when the duvet cover is manipulated during use. Also, the down feather sheet 14 provides a duvet cover with substantially uniform thermal insulating density throughout as well as uniform thickness.

With reference to FIGS. 2A and 2B, the down feather sheet 14 is comprised of loose down feathers 18 mixed with a binder herein polyethelene fibers 19 or a powder adhesive binder and deposited on a support backing sheet 20 where it is caused to bind by the application of heat to form a homogeneous down feather sheet. FIG. 2B shows another embodiment of the down feather sheet where the down is trapped and bound together and between opposed cover sheets 20 and 20'. The down feather sheet 14 may also be formed as disclosed in my above mentioned U.S. Pat. No. 6,025,041 where the down feathers are bound together to form a homogeneous sheet without the use of support fiber sheets wherein the down sheet is of very light weight.

As shown in FIG. 3, a slit opening 21 may be formed adjacent an edge of the duvet cover, herein the top edge to remove the down feather sheet 14 when washing the duvet cover. A fabric slit cover flap 22 is formed by an over-turned edge portion of the base sheet 12 or the flap may be formed by a different fabric piece sewn on a top edge section of the duvet cover to conceal the slit.

Figure 4A:
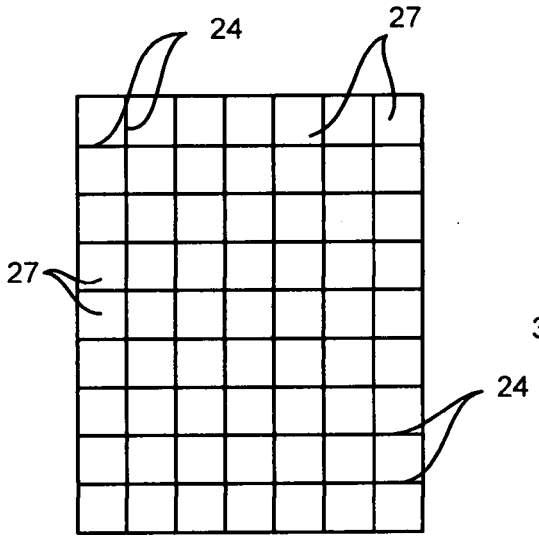
(PRIOR ART) FIG. 4A
FIG. 4A is a plan view of a duvet cover constructed in accordance with the prior art.
Figure 4B:
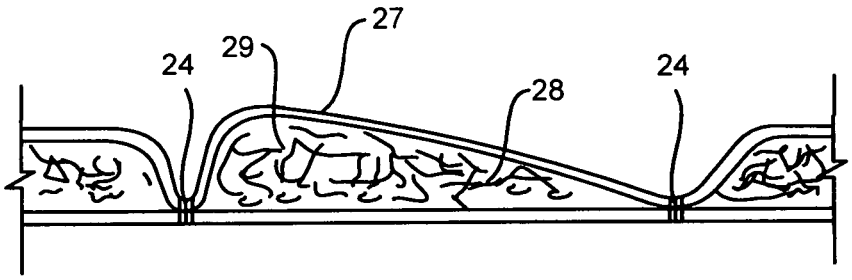
(PRIOR ART) FIG. 4B
FIG. 4B is a partial cross-section view of prior art FIG. 4A showing the distribution of down feathers in the pockets.

FIGS. 4A and 4B illustrate some of the above mentioned prior art quilt pattern stitch seam designs formed in duvet cover to maintain the loose down feathers between the base sheet 25 and the top sheet 26. As shown in FIG. 4A, the quilt pattern stitch seams 24 produces small square pockets 27 into which down is held captive. However, the close spacing of the stitch seams makes it impossible to achieve a high loft in the down feathers trapped in these small pockets 27 and therefore limiting the insulation factor of the down in the duvet cover. As shown in FIG. 4B, when larger pockets 27 are formed by spacing the stitch seam lines 24 further apart, the loosed down heathers 28 in the large pockets 27 are unstable, and as herein shown the down propagates unevenly in these large pockets to form down clusters 29 where the insulation factor is high, and areas 30 where there is very little or no down and wherein the insulation factor is very low. This creates a duvet cover with cold spots created by irregular distribution of the down and accordingly irregular thermal insulation. These prior art disadvantages are obviated by the duvet cover 10 manufactured according to the present invention.

Figure 5A:
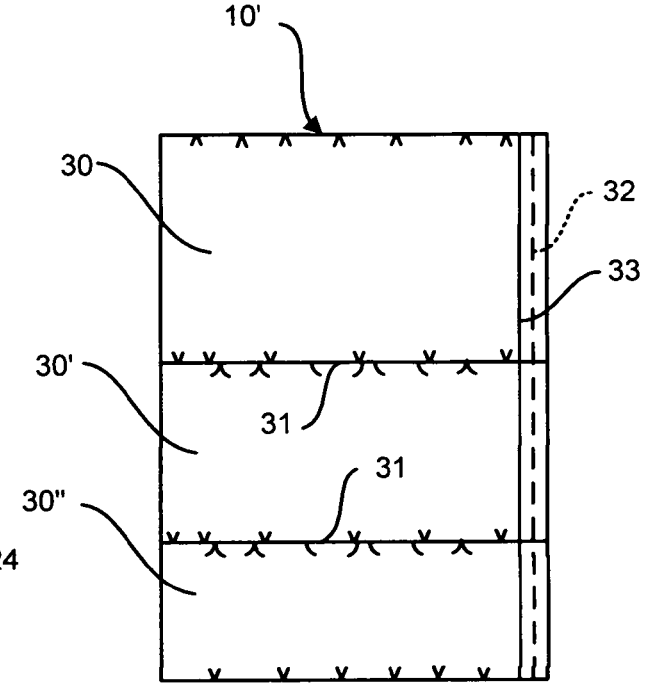
FIG. 5A is a plan view of a duvet cover having large transverse pockets to retains down feather sheets having different thermal insulation factors.
Figure 5B:
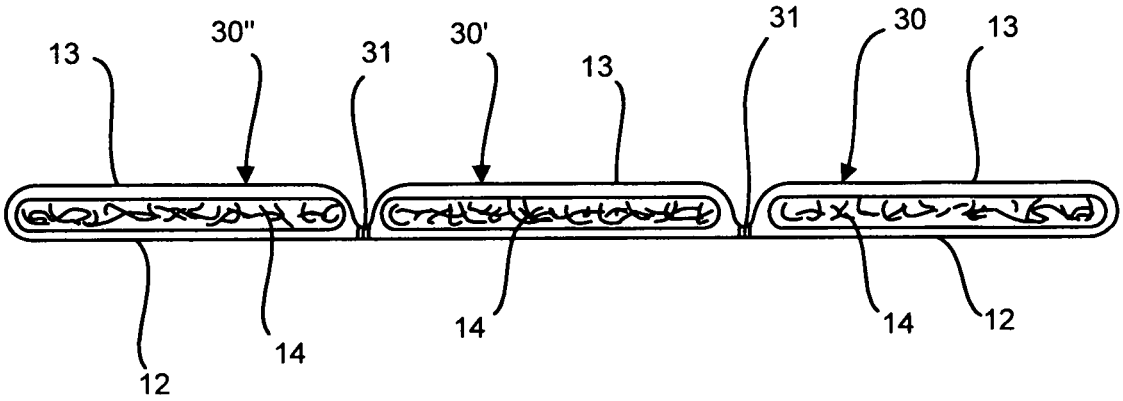
FIG. 5B is a cross-section view, not to scale, of FIG. 5A.
Figure 5C:
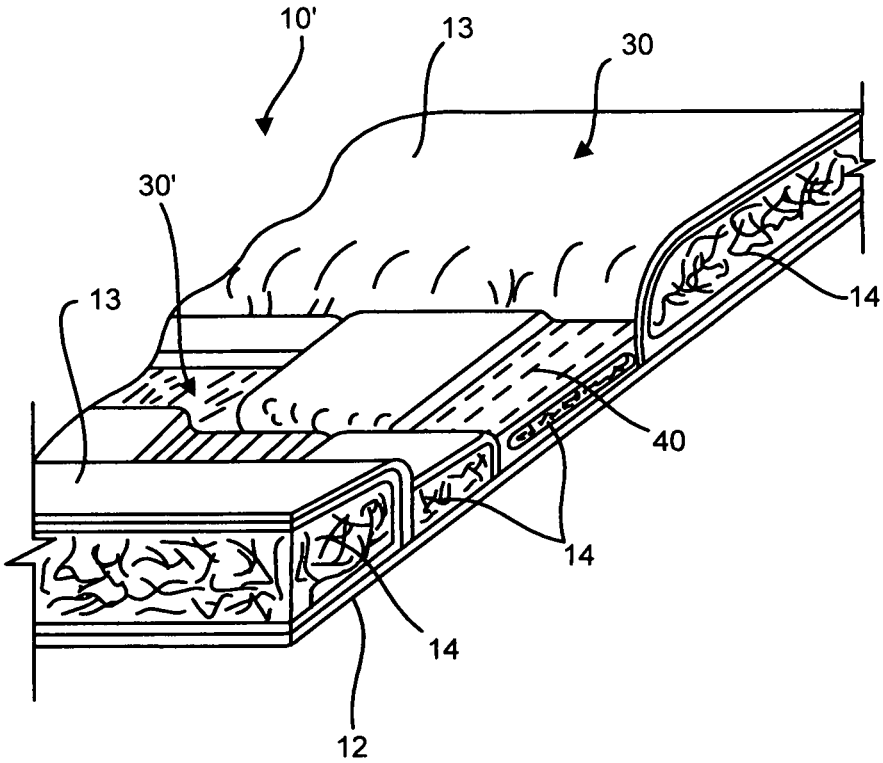
FIG. 5C is a fragmented perspective view illustrating a stitched design pattern comprised of compressed stitched areas of different size and stitch line spacings.

It is also desirable to also produce a duvet cover wherein a specific section or sections of the duvet cover has a different thermal insulating factor to form areas which are cooler on specific sections of the body or a user person. This is achievable with the present invention by different duvet designs formed by pattern stitch seams. Some of such designs are illustrated by FIGS. 5A to 5C. As shown in FIGS. 5A and 5B, the duvet cover 10' is formed with three large transverse pocket sections 30, 30' and 30" in which there is retained a down feather sheet, with one or all of the sheets having a different thermal insulating factors or density. In the embodiment illustrated, the pocket section 30' has an insulating factor inferior to the other two pocket sections 30 and 30" to provide less insulation or warmth in the lower torso section of a person's body which is favourable to a person's health when asleep. The pocket sections are defined by transverse seam lines 31 extending across the duvet cover 10'. Slits 32 may be formed at the end of each pocket sections for insertion and removal of the down feather sheets. Each slit 32 is concealed by a flap 33 formed as previously described.

Figure 6A:
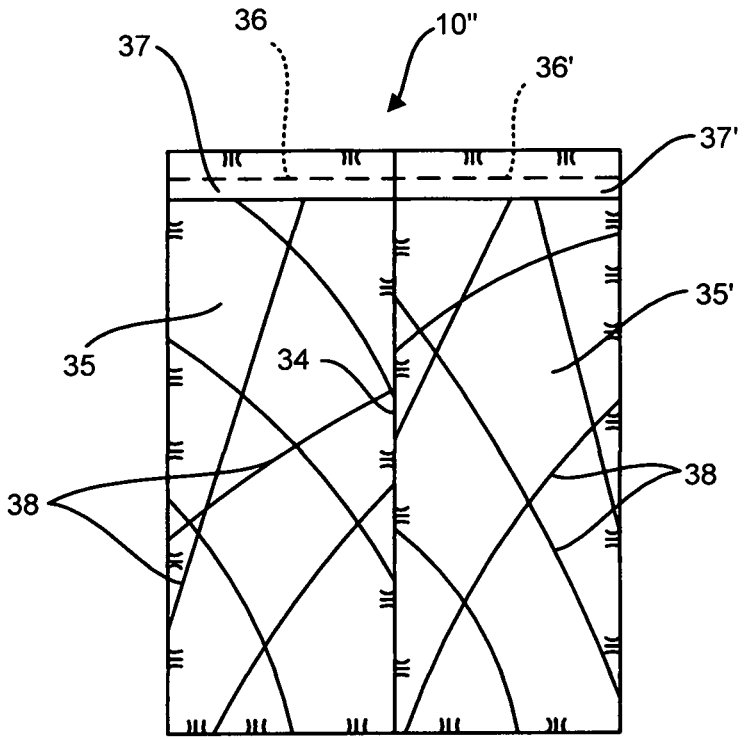
FIG. 6A is a plan view of a duvet cover which is segmented into two half sections with the sections provided with a down feather sheet having different thermal insulation factors and wherein an irregular stitched design pattern is formed in the top sheet of the sections.
Figure 6B:
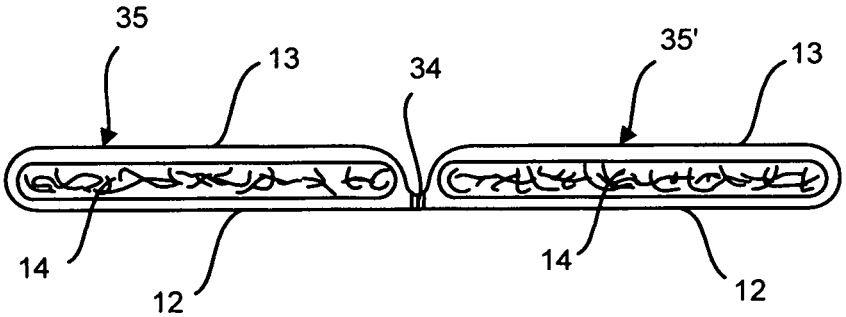
FIG. 6B is a cross-section view, not to scale, of FIG. 6A.

FIGS. 6A and 6B illustrate a further duvet cover 10" wherein the duvet cover is sectioned longitudinally by a central stitch seam 34 to form two half pocket sections 35 and 35' to receive therein a down feather sheet having different thermal insulating factors wherein a person sleeping on one side of the bed receives less warmth from the duvet cover 10" than the person sleeping on the other side to suit the desire of the user persons. Again the down feather sheet is inserted and removed from these two sections through associated slits 36 and 36' formed along an edge of the duvet cover and concealed by respective flaps 37 and 37'. If the down feather sheet is meant to be a fixed and non-removable part of the duvet cover 10", deign stitch seams 38 may be formed in the duvet cover.

FIG. 5C illustrates a still further embodiment of the duvet cover of FIG. 5A, wherein the sections 30, 30' and 30" do not contain a removable down feather sheet but a permanent down feather sheet and wherein the loft of the down feathers in their sections is modified by applying design stitch seam patterns formed by stitching. As shown the central transverse section 30' has a design pattern throughout with design portions in the pattern having close stitch lines, such as portion 40, to compress the down feathers in that section thereby reducing the loft of the down and the air trapped therein to provide down compressed zones of less thermal insulating efficiency. Other design portions are formed as small square portions 41 wherein the down is less compressed than in the portion 40 but more compressed than in the adjacent section 30 whereby to form a band or section 30' having an overall reduced thermal insulation efficiency than the adjacent sections 30 and 30' to achieve the same result as the embodiment illustrated in FIG. 5A while providing an esthetic patch design feature in a large band extending across the duvet cover 10' Because the down feathers are not loosely retained between the base sheet 12 and the top sheet 13 all sorts of stitch designs can be made without concern of forming cold spots in the duvet cover due to loose down insulation.

Figure 7:
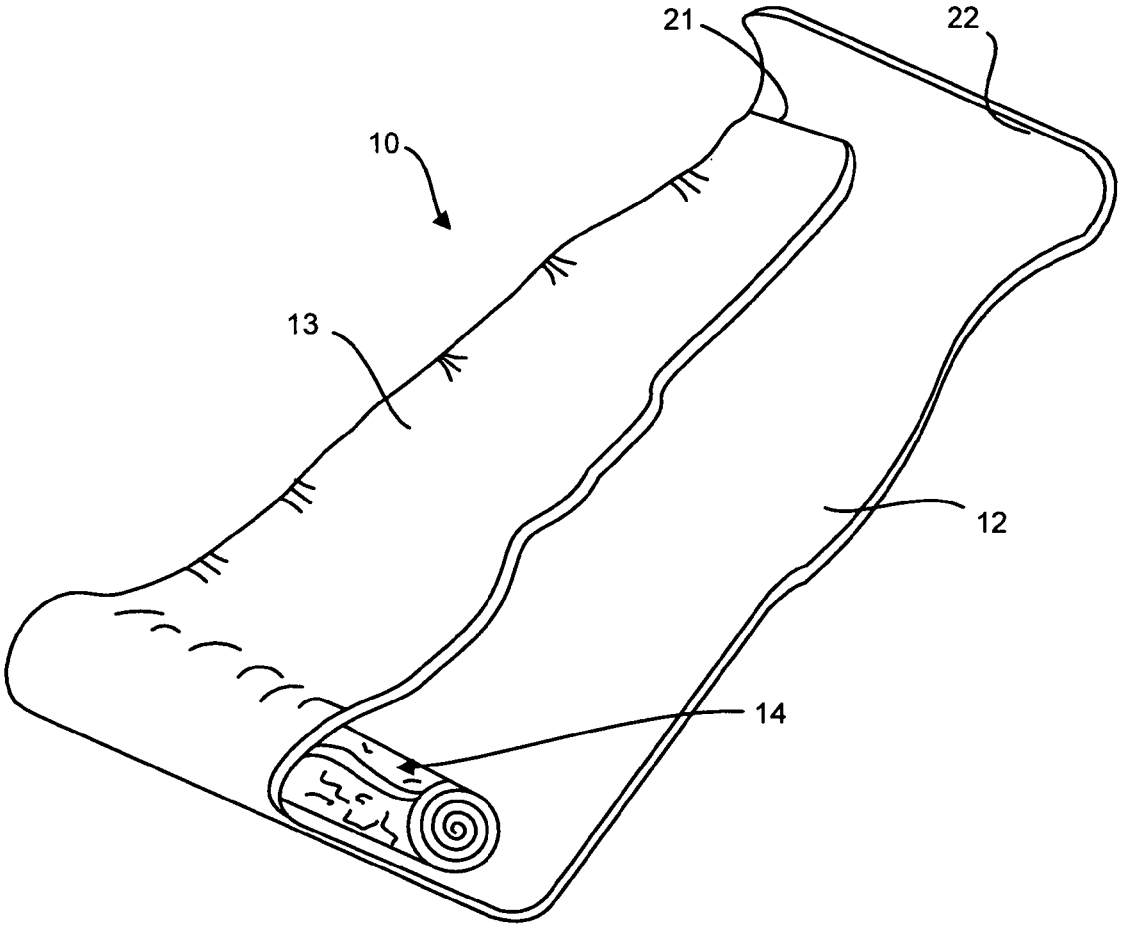
FIG. 7 is a fragmented perspective view of a duvet cover wherein the down feather sheet is rolled to a bottom of the duvet cover, such as to remove the insulation factor of for ease of storage of the duvet cover.
Figure 8:
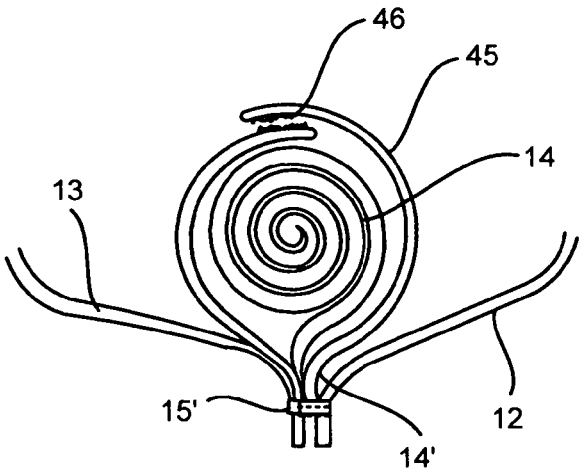
FIG. 8 is a fragmented cross-sectional view illustrating the rolled-up down feather sheet held captive in a pouch formed along the bottom edge inside the duvet cover.
Figure 9:
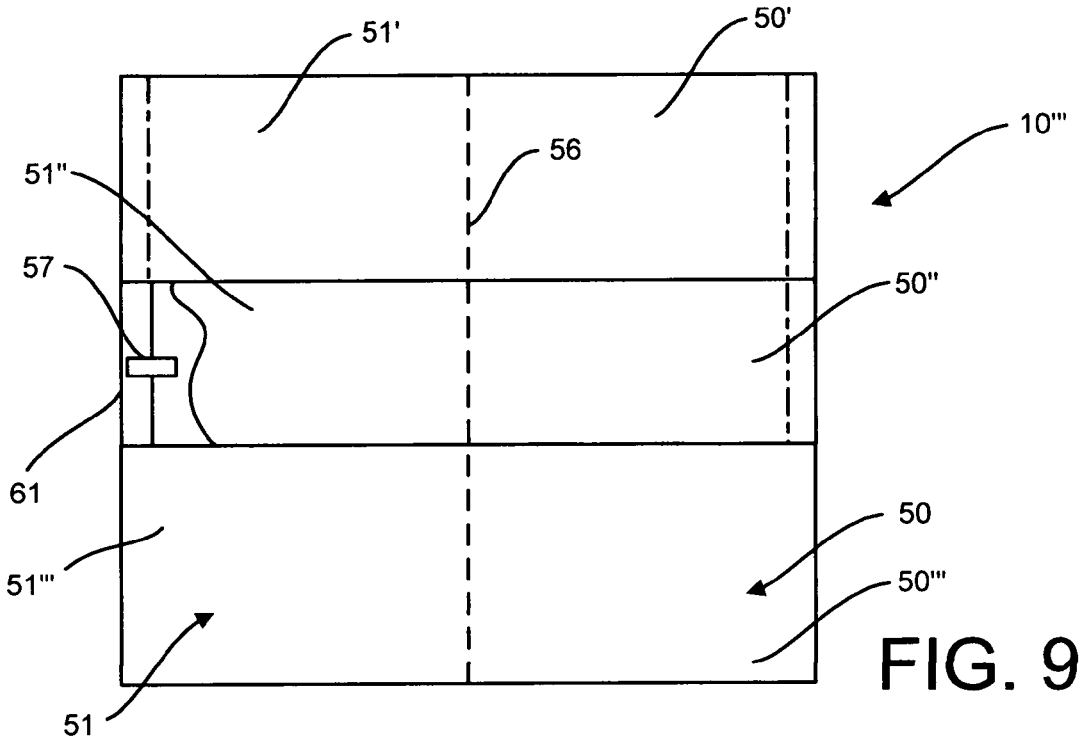
FIG. 9 is a plan view of the duvet cover formed of two independent longitudinal sections with each section formed in three transverse sections each having a double layer down feather sheet with the top layer being adapted to be rolled upon itself along a side edge of the duvet cover.

With reference now to FIGS. 7 and 8 there is shown another embodiment of the duvet cover 10 of a type such as illustrated in FIG. 3 wherein the down feather sheet 14 has a bottom edge section 14' held captive by the peripheral seam 15' formed in the lower edge of the duvet cover. The slit opening 21 provides access to the down feather sheet 14 to permit the down feather sheet to be rolled-up between the base sheet 12 and the top sheet 13 and stored in the bottom end of the duvet cover when not required during warmer weather periods. Still further a storage pouch 45 may be formed and attached in the lower peripheral seam 15' to retained the down feather sheet roll captive therein. The pouch can be held closed by a zipper fastener of Velcro (Registered Trademark) fastener 46 as herein illustrated. The down feather sheet is made easily accessible by turning the base sheet and top sheet inside-out through the slit 21.

Figure 10:
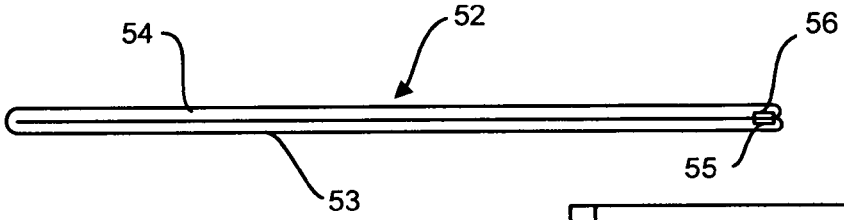
FIG. 10 is a cross-sectional side view of the double layer down feather sheet.

Referring now to FIGS. 9 to 12 there is illustrated another embodiment of the present invention wherein the duvet cover 10" is a two-sided duvet cover, a first side 50 and an adjacent second side 51, such as for use on a king size bed. Each side 50 and 51 is divided into three transverse sections, 50', 50" and 50'" for the first side and 51', 51" and 51'" for the adjacent section 51. In each of these sections the is secured a double layer down feather sheet 52, as illustrated in FIG. 10.

The bottom layer 53 of the double layer down feather sheet is secured to the base sheet 12 of the duvet cover adjacent a central longitudinal seam 56 by a snap attachment 55 or other suitable fastener or attachment. The tip layer 54 of the double layer down feather sheet 52 is detachably secured to the bottom layer 53 above the attachment 55 also by a snap attachment 56 or other suitable connection. Each down sheet layer 53 and 54 my have, for example, 50 grams/square meter of down feathers from goose or duch. Accordingly, the double layer sheet when folded provides insulation in the order of 100 grams/square meter. If the top layer 54 is rolled upon itself along the edge of the duvet cover the insulating factor in any of the transverse sections can be reduced by half. Accordingly, the user person can adapt its side of the duvet cover for its personal comfort.

Figure 11:
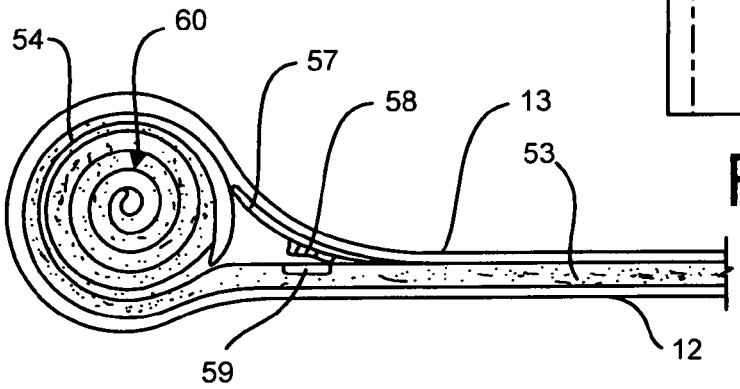
FIG. 11 is a plan view of a duvet cover with a single double down feather sheet with the top down layer rolled to a side and retain in a manner as shown in FIG. 12.

As shown in FIG. 11 the top layer 54 has been rolled-up in a tight roll 60 along the edge 61 of the duvet cover and is retained in that position by one or more retaining flaps 57 sewn to the inside face of the top sheet 13 of the duvet cover 10'". A Velcro (registered trademark) connector 58 is secured to the retaining flap 57 and to another like matting connector 59 secured to a predetermined location on the bottom down feather sheet 53. Accordingly, the roll 60 is retained firmly in place. Every one of the transverse sections can be adjusted to suit the preference of each user person.

Figure 12:
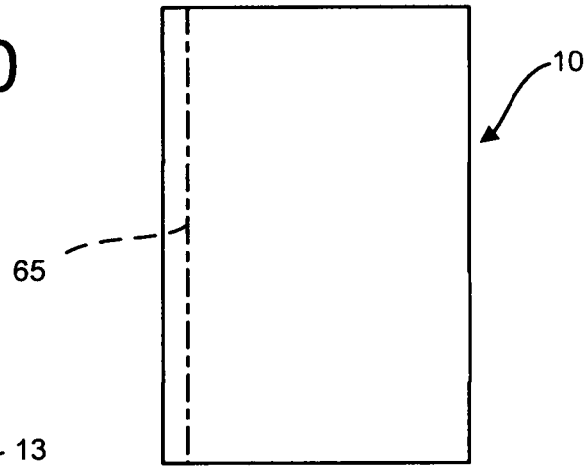
FIG. 12 is an enlarged fragmented cross-sectional view illustrating the top layer of the down sheet rolled on itself and retained by a holding flap.

FIG. 12 shows a duvet cover 10 having a double layer down feather sheet which can form a roll 65 of its top layer for storage along a side edge of the duvet cover.

It is conceivable that the double layer down feather sheet can also be used in articles of apparel where the top sheet can be rolled to a concealing location and held in a pouch form with the article of apparel. Still, other applications the double layer down feather sheet are conceivable, It is within the ambit of the present invention to cover various obvious modifications of the embodiments and examples described herein provided such modifications fall within the scope of the appended claims.

The invention claimed is:

1. A duvet cover comprising a base sheet and a top sheet interconnected by peripheral stitched seams to form a duvet cover pouch, a rectangular down feather sheet retained in said duvet cover pouch, said down feather sheet having a substantially constant density of down feathers with said down feathers being retained captive by a binder to prevent said down feathers from displacement between said base sheet and said top sheet when said duvet cover is manipulated during use, said down feather sheet being a rectangular down feather sheet retained captive in said duvet cover pouch between said base sheet and said top sheet by a bottom edge portion of said peripheral stitched seam extending in a bottom edge of said pouch, and a slit opening formed transversely in said duvet cover pouch adjacent a top edge of said duvet cover pouch for access to said down feather sheet to permit a user person to roll said down feather sheet from a free top edge thereof to form a tight roll of said down feather sheet for storage at a storage position adjacent said bottom edge of said pouch and between said base sheet and said top sheet, and retention means to retain said roll of said down feather sheet at said storage position, said retention means being a transverse storage pouch retained by said peripheral stitched seam along said bottom edge of said pouch, said down feather sheet being secured inside said storage pouch, said storage pouch having a closure to retain said down feather sheet at said storage position, said slit opening of said duvet cover pouch permitting said base sheet and said top sheet to be turned inside-out for access to said down feather sheet and said storage pouch.

2. The duvet cover as claimed in claim 1 wherein said down sheet is comprised by down feathers mixed with said binder to form a down feather layer of substantially constant thickness with said down feather layer adhered to at least one fabric sheet.

3. The duvet cover as claimed in claim 2 wherein said down layer is adhered between opposed fabric sheets.

4. A duvet cover comprising a base sheet and a top sheet interconnected by peripheral stitched seams to form a duvet cover pouch, a rectangular down feather sheet retained in said duvet cover pouch, said down feather sheet having a substantially constant density of down feathers with said down feathers being retained captive by a binder to prevent said down feathers from displacement between said base sheet and said top sheet when said duvet cover is manipulated during use, said down feather sheet being a rectangular down feather sheet retained captive in said duvet cover pouch between said base sheet and said top sheet by a bottom edge portion of said peripheral stitched seam extending in a bottom edge of said pouch, and a slit opening formed transversely in said duvet cover pouch adjacent a top edge of said duvet cover pouch for access to said down feather sheet to permit a user person to roll said down feather sheet from a free top edge thereof to form a tight roll of said down feather sheet for storage at a storage position adjacent said bottom edge of said pouch and between said base sheet and said top sheet, and retention means to retain said roll of said down feather sheet at said storage position, and wherein said down feather sheet is a double layer down feather sheet, a bottom layer being detachably securable to said base sheet and a top layer thereof being capable of being rolled to said bottom edge of said duvet cover pouch between said base sheet and said top sheet and held in a roll form whereby to reduce in half the thermal insulation factor of said down feather sheet in said duvet cover to suit the needs of a user person.

5. The duvet cover as claimed in claim 4 wherein said down sheet is comprised by down feathers mixed with said binder to form a down feather layer of substantially constant thickness with said down feather layer adhered to at least one fabric sheet.

6. The duvet cover as claimed in claim 5 wherein said down layer is adhered between opposed fabric sheets.

* * * * *